US007747187B2

(12) United States Patent
Kurita et al.

(10) Patent No.: US 7,747,187 B2
(45) Date of Patent: Jun. 29, 2010

(54) CLEANING DEVICE AND IMAGE FORMING APPARATUS

(75) Inventors: Tomokazu Kurita, Kanagawa (JP); Koji Nishimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/285,164

(22) Filed: Sep. 30, 2008

(65) Prior Publication Data

US 2009/0060563 A1 Mar. 5, 2009

Related U.S. Application Data

(62) Division of application No. 11/505,403, filed on Aug. 17, 2006, now Pat. No. 7,457,559.

(30) Foreign Application Priority Data

Jan. 25, 2006 (JP) ..... 2006-016726

(51) Int. Cl.
*G03G 15/02* (2006.01)

(52) U.S. Cl. ..... 399/100; 399/110; 399/176

(58) Field of Classification Search ..... 399/100, 399/174, 176, 107, 110
See application file for complete search history.

(56) References Cited

U.S. PATENT DOCUMENTS

| | | | | |
|---|---|---|---|---|
| 6,038,418 | A | 3/2000 | Chigono et al. | 399/174 |
| 6,163,671 | A | 12/2000 | Ishiyama et al. | 399/176 |
| 6,665,507 | B1 * | 12/2003 | Hooper et al. | 399/110 |
| 2007/0104504 | A1 | 5/2007 | Terai et al. | 399/100 |

FOREIGN PATENT DOCUMENTS

| | | | |
|---|---|---|---|
| JP | 7-209959 | | 8/1995 |
| JP | 10-142897 | A | 5/1998 |
| JP | 10-213967 | | 8/1998 |
| JP | 2001-092219 | A | 4/2001 |
| JP | 2003-207996 | | 7/2003 |
| JP | 2003-215889 | | 7/2003 |
| JP | 2004-020844 | A | 1/2004 |
| JP | 2005-227411 | A | 8/2005 |
| JP | 2006-003593 | | 1/2006 |
| JP | 2006-047792 | A | 2/2006 |
| JP | 2006-330613 | | 12/2006 |
| KR | 10-2005-0108907 | | 11/2005 |

OTHER PUBLICATIONS

Machine translation of JP 10-142897 A, dated Mar. 31, 2008.
Machine translation of JP 2001-092219 A, dated Mar. 31, 2008.
Machine translation of JP 2005-227411 A, dated Mar. 31, 2008.
Machine translation of JP 2006-047792 A, dated Mar. 31, 2008.

* cited by examiner

*Primary Examiner*—Sophia S Chen
(74) *Attorney, Agent, or Firm*—Morgan, Lewis & Bockius LLP

(57) ABSTRACT

A cleaning device includes a cleaning roll and an intervening member. The cleaning roll contacts the surface of a charge roll that charges a photoconductor, rotates, and cleans the surface of the charge roll. The intervening member is intervened between the charge roll and the cleaning roll and causes the charge roll and the cleaning roll to separate from each other. The intervening member may be spacers that are intervened at both end portions of the charge roll and the cleaning roll and form a gap between the charge roll and the cleaning roll. The intervening member may also be a lubricant.

2 Claims, 6 Drawing Sheets

CLEANING DEVICE AND IMAGE FORMING APPARATUS

This is a divisional application of application Ser. No. 11/505,403, filed on Aug. 17, 2006, now U.S. Pat. No. 7,457,559 which is hereby incorporated by reference.

BACKGROUND

1. Technical Field

The present invention relates to a cleaning device that cleans a charge roll and an image forming apparatus having the cleaning device.

2. Related Art

A charge roll that charges the surface of a photoconductor directly contacts the photoconductor. For this reason, it is easy for foreign matter remaining on the surface of the photoconductor to adhere to the surface of the charge roll. When foreign matter adheres to the surface of the charge roll, this causes defective charging.

Thus, a cleaning roll made of a sponge is brought into contact with the surface of the charge roll with a predetermined nip pressure, and the cleaning roll is rotated while following the rotation of the charge roll, whereby dirt on the surface of the charge roll is removed.

SUMMARY

According to an aspect of the present invention, there is provided a cleaning device including a cleaning roll that contacts a surface of a charge roll that charges an image carrier, rotates, and cleans the surface of the charge roll; and an intervening member that is intervened between the charge roll and the cleaning roll and causes the charge roll and the cleaning roll to separate from each other.

BRIEF DESCRIPTION OF THE DRAWINGS

Exemplary embodiments of the present invention will be described in detail based on the following figures, wherein.

DETAILED DESCRIPTION

Figure 1:
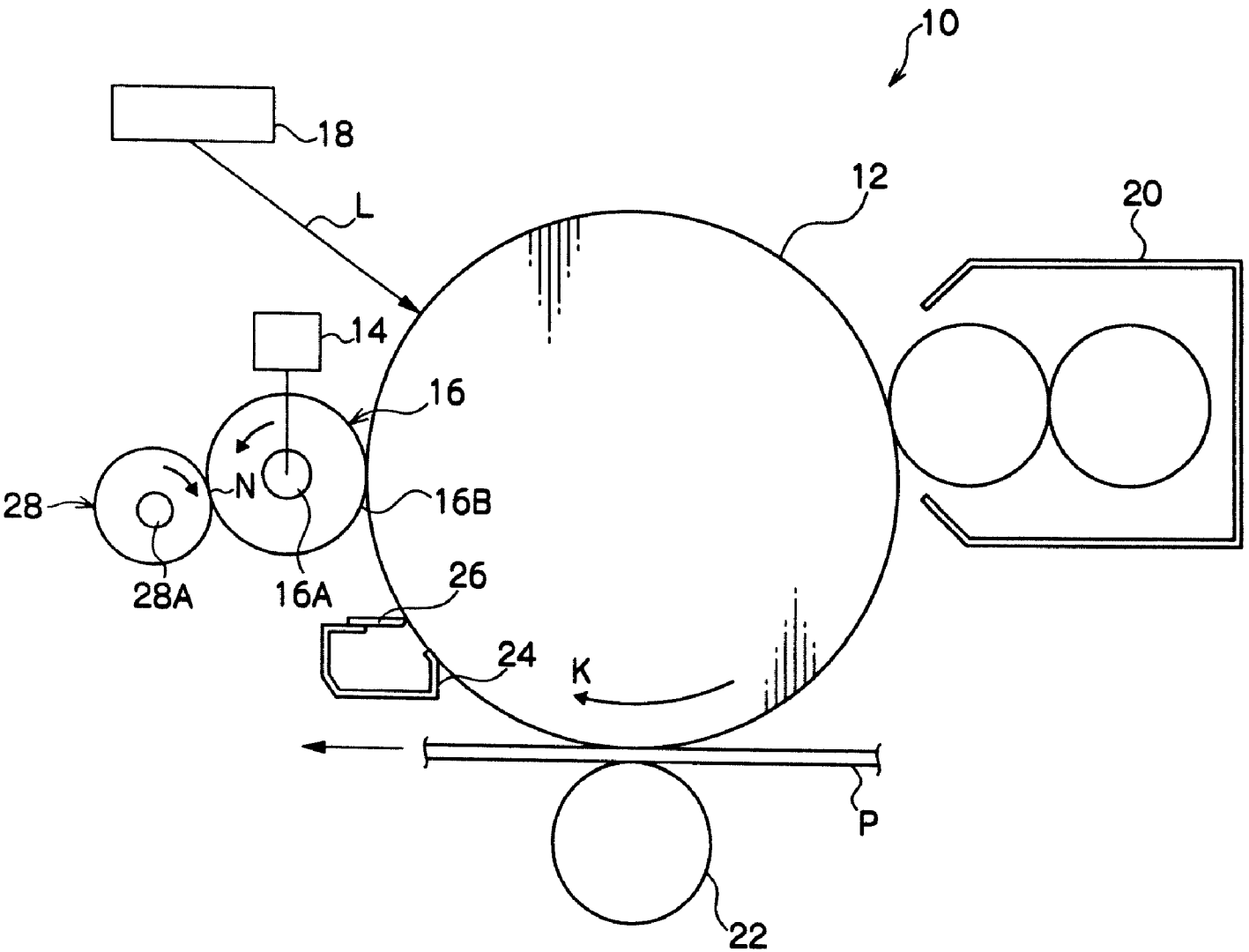
FIG. 1 is a schematic diagram of an image forming apparatus disposed with a cleaning device pertaining to a first exemplary embodiment of the present invention.

FIG. 1 shows the schematic configuration of an image forming apparatus 10 disposed with a cleaning roll 28 serving as a cleaning device pertaining to a first exemplary embodiment of the present invention.

The image forming apparatus 10 forms a toner image on the basis of image information inputted from an external device and records this image on recording paper P by a known electrophotographic process. It will be noted that, in the following description, detailed description of that which is not directly related to the essence of the present invention will be omitted.

First, the general configuration of the image forming apparatus 10 and the general process of forming an image on the recording paper P will be described.

As shown in FIG. 1, the image forming apparatus 10 includes a photoconductor drum 12. The photoconductor drum 12 is rotated in the direction of arrow K by a drive component.

The surface of the photoconductor drum 12 is charged to a predetermined charge potential by a charge roll 16 to which direct-current electricity is supplied by a power supply 14. After the surface of the photoconductor drum 12 is charged, it is exposed to a laser beam L that corresponds to image information and is emitted from a light scanning device 18, whereby a latent image corresponding to the image information is formed on the surface of the photoconductor drum 12. The latent image formed on the surface of the photoconductor drum 12 is developed by a developing device 20, and a toner image is formed on the photoconductor drum 12. The toner image is then transferred to the recording paper P by a transfer roll 22. The recording paper P to which the toner image has been transferred is fed to a fixer, where the toner image is fixed to the recording paper P by heat and pressure. The recording paper P to which the toner image has been fixed is then discharged to a paper discharge tray.

Not all of the toner image formed on the photoconductor drum 12 is transferred to the recording paper P by the transfer roll 22; some of it remains on the photoconductor drum 12 as residual toner. This residual toner is scraped off and removed by a cleaning blade 26 of a cleaning device 24 disposed on the periphery of the photoconductor drum 12 between the charge roll 16 and the transfer roll 22.

The charge roll 16 is disposed at the side of the photoconductor drum 12 such that it contacts the photoconductor drum 12. The charge roll 16 comprises a conductive shaft 16A and a charge layer 16B that is disposed around the conductive shaft 16A. The shaft 16A is rotatably supported on a frame of the image forming apparatus 10.

Free-cutting steel or stainless steel is used as the material of the shaft 16A. The material and surface treatment method are timely selected in accordance with the purpose, such as slideability. Material that is not conductive may be treated by a common treatment such as plating to make it conductive.

The conductive elastic layer configuring the charge layer 16B of the charge roll 16 comprises an elastic material such as rubber and a conductive material such as carbon black or an ion conductive material that adjusts the resistance of the conductive elastic layer. Materials that can ordinarily be added to rubber—such as a softening agent, a plasticizing agent, a hardening agent, a vulcanizing agent, a vulcanization accelerating agent, an anti-aging agent, and a filling agent such as silica and calcium carbonate—may also be added. The charge layer 16B is formed by covering the peripheral surface of the conductive shaft 16A with a mixture in which the materials ordinarily added to rubber have been added. A conductive agent in which is dispersed a material that electrically conducts electrons and/or ions as charge carriers—such as carbon black arranged in a matrix or an ion conductive agent—can be used as a conductive agent for the purpose of adjusting the resistance.

The surface layer configuring the charge layer 16B is formed in order to prevent contamination by foreign matter such as toner. The material of the surface layer is not particularly limited; resin or rubber, for example, may be used. Examples include polyester, polyimide, copolymer nylon; silicone resin, acrylic resin, polyvinyl butyral, ethylene-tetrafluoroethylene copolymer, melamine resin, fluoro-rubber, epoxy resin, polycarbonate, polyvinyl alcohol, cellulose, polyvinylidene chloride, vinyl chloride, polyethylene, and ethylene vinyl-acetate copolymer.

Further, a conductive material can be added to the surface layer to adjust the resistance. It is preferable for the conductive material to be one whose particle diameter is 3 μm or less.

Further, a conductive agent in which is dispersed a material that electrically conducts electrons and/or ions as charge carriers—such as carbon black arranged in a matrix, conductive metal oxide particles, or an ion conductive agent—can be used as a conductive agent for the purpose of adjusting the resistance.

The conductive metal oxide particles that are conductive particles for adjusting the resistance are conductive particles such as tin oxide, tin oxide doped with antimony, lead oxide, anatase titanium oxide, and indium tin oxide (ITO). Any agent can be used as long as it is a conductive agent where electrons serves as charge carriers, and the conductive metal oxide particles are not particularly limited. These can be used singly, or two or more different types can be used together. Further, although the conductive metal oxide particles may be of any particle diameter as they do not inhibit the present invention, tin oxide, tin oxide doped with antimony, and anatase titanium oxide are preferable in terms of resistance adjustment and strength, and tin oxide and tin oxide doped with antimony are particularly preferable.

By controlling the resistance with this conductive material, stable characteristics are obtained without the resistance of the surface layer changing due to environmental conditions.

Moreover, fluorine or silicone resin is used in the surface layer. In particular, it is preferable for the resin to be configured by a fluorine degeneration acrylate polymer. Microparticles may also be added to the surface layer. Thus, the microparticles act such that the surface layer becomes hydrophobic and the adherence of foreign matter to the charge roll 16 is prevented. It is also possible to add insulating particles such as alumina or silica, impart unevenness to the surface of the charge roll 16, reduce the burden when the surface layer rubs the photoconductor drum 12, and improve abrasion resistance between the charge roll 16 and the photoconductor drum 12.

The cleaning roll 28 that contacts the surface of the charge roll 16 is disposed on the side of the charge roll 16 opposite from the side facing the photoconductor drum 12. The cleaning roll 28 comprises a shaft 28A and a sponge layer 28B comprising foam urethane or foam rubber that is disposed around the shaft 28A. The shaft 28A is rotatably supported on the frame of the image forming apparatus 10.

Free-cutting steel or stainless steel is used as the material of the shaft 16A. The material and surface treatment method are timely selected in accordance with the purpose, such as slideability. Material that is not conductive may be treated by a common treatment such as plating to make it conductive, or of course may be used as is. Further, because the cleaning roll 28 contacts the charge roll 16 with an appropriate nip pressure via the sponge layer 28B, a material having a strength that does not bend at the time of nipping and a shaft diameter having sufficient rigidity with respect to the shaft length are selected.

The sponge layer 28B has a circular cylinder shape, comprises a foam body having a porous three-dimensional structure, includes cavities or uneven portions (called "cells" below) inside and on its surface, and is elastic. The sponge layer 28B is selected from a layer whose material comprises foam resin or rubber such as polyurethane, polyethylene, polyamide, or polypropylene. Thus, the sponge layer 28B, which includes numerous cells, can be manufactured inexpensively.

Further, polyurethane, which has high tearing strength and high tensile strength, is particularly preferably used for the sponge layer 28B in order to ensure that the sponge layer 28B effectively cleans foreign matter such as an external additive 17C (see FIG. 3A) by following the rotation of and rubbing the charge roll 16 and to ensure that the surface of the charge roll 16 is not damaged by the rubbing of the sponge layer 28B and that breakage and damage do not occur over a long period of time. It will be noted that the cleaning member of the cleaning roll 28 may also be configured by a blade, a brush, or a rag.

It is preferable for the number of cells in the cleaning roll 28 to be 40 to 80 cells per 25 mm, and more preferable for the number of cells in the cleaning roll 28 to be 45 to 75 cells per 25 mm. By setting the number of cells to this range, it becomes easier for foreign matter such as toner 17A (see FIG. 3A) and the external additive 17C to be collected inside the cells and easier to spread the collected foreign matter such as the external additive 17C to the charge roll 16 and the photoconductor drum 12.

The cleaning roll 28 is disposed such that it presses against the charge roll 16 with a predetermined load. The sponge layer 28B becomes elastically deformed along the circumferential surface of the charge roll 16 to form a nip portion N.

According to this configuration, when the photoconductor drum 12 is rotatingly driven in the clockwise direction in FIG. 1 (the direction of arrow K), the charge roll 16 rotates counterclockwise following the rotation of the photoconductor drum 12. Further, the cleaning roll 28 rotates clockwise following the rotation of the charge roll 16.

Figure 2:
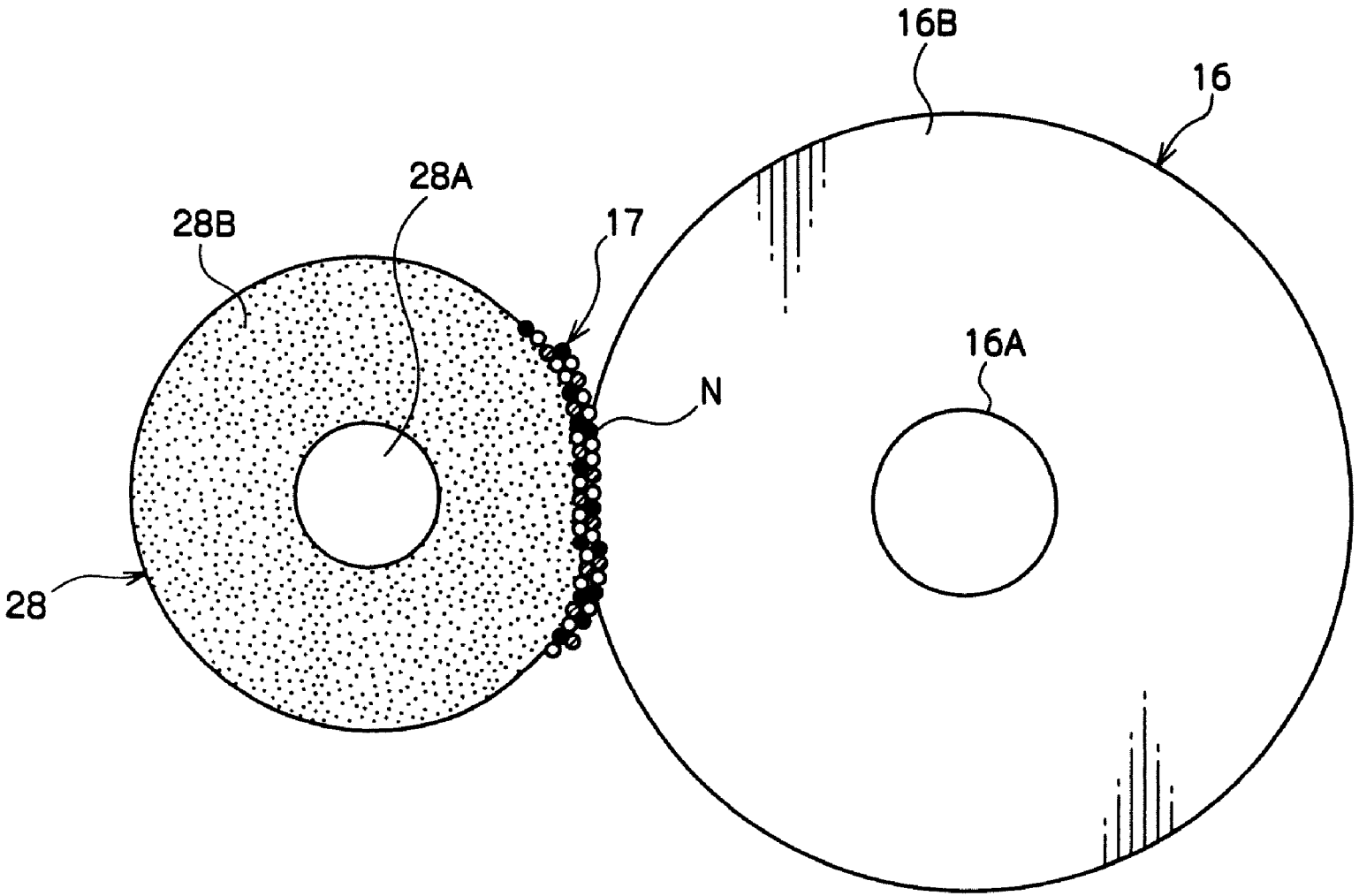
FIG. 2 is a side view where the cleaning device is seen from an axial direction.

In the image forming apparatus 10 having this configuration, the charge roll 16 is charged by the power supply 14 to cause a lubricant 17 serving as a lubricant to be electrostatically attracted to the charge roll 16 prior to shipment or transport. Additionally, the charge roll 16 is rotated, and as shown in FIG. 2, the lubricant 17 is intervened between the charge roll 16 and the cleaning roll 28 (i.e., in the nip portion N).

Figure 3B:
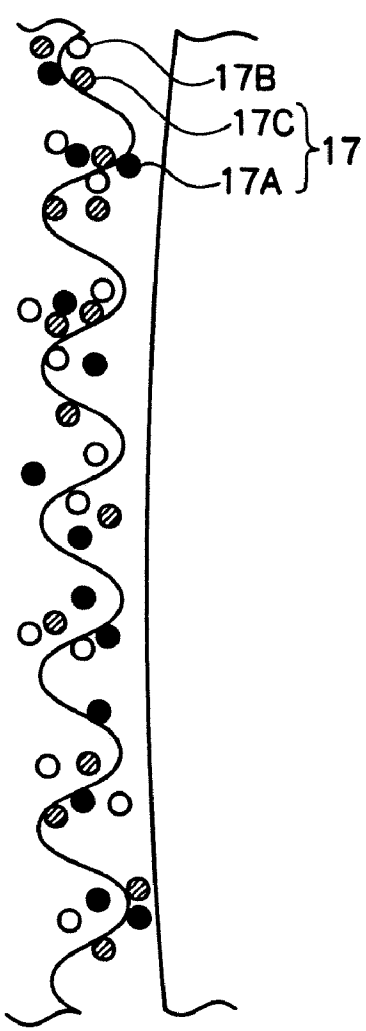
FIGS. 3A and 3B are enlarged views where a nip portion between a charge roll and a cleaning roll is seen from the axial direction.
Figure 3A:
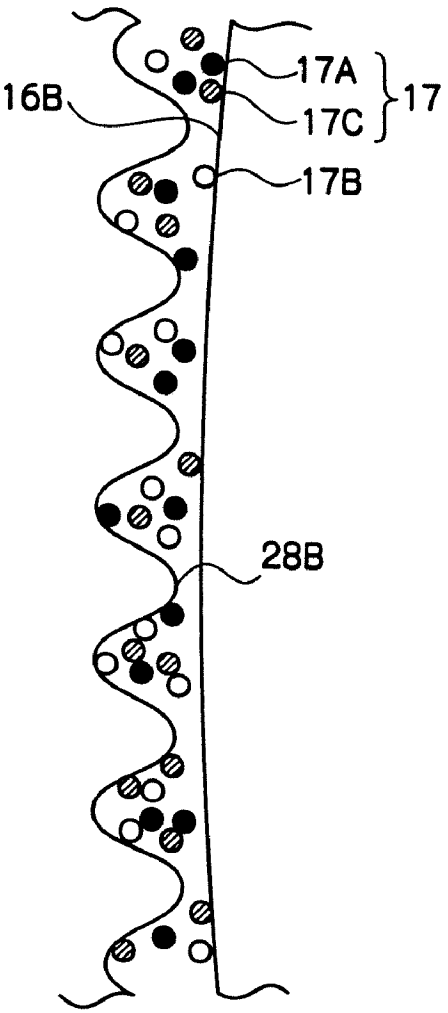

As shown in FIG. 3A, the lubricant 17 comprises a mixture of a two-component developing agent, which comprises the toner 17A and a carrier 17B, and the external additive (micropowder such as silica) 17C. By intervening the lubricant 17 between the charge roll 16 and the cleaning roll 28, the charge roll 16 and the cleaning roll 28 do not contact each other directly.

Thus, even if the image forming apparatus 10 is stored for a long period of time, deformation of the cleaning roll 28 can be controlled because the charge roll 16 and the cleaning roll 28 are separated from each other.

Further, because the cleaning roll 28 does not directly contact the charge roll 16, it becomes easier for the charge roll 16 and the cleaning roll 28 to rotate by oscillation from the outside. Thus, it becomes difficult for the surface of the cleaning roll 28 (the sponge layer 28B) to become deformed because pressing force is not applied over a long period of time to one place one the cleaning roll 28.

Consequently, because the surface speed of the charge roll 16 does not vary periodically by the cleaning roll 28 that is rotated by the charge roll 16 when the charge roll 16 rotates, image defects such as density unevenness are not caused, and excellent images can be obtained over a long period of time.

Further, because the cleaning roll 28 is formed by a sponge member, the toner 17A and the external additive 17C added to the toner become collected (enter) inside the cells of the sponge layer 28B, as shown in FIG. 3B. Thus, the hardness of the sponge layer 28B becomes higher, and deformation of the surface of the cleaning roll 28 (i.e., the sponge member) is controlled. Further, the surface of the cleaning roll 28 is protected because the toner 17A and the external additive 17C adhere to the surface of the sponge layer 28B.

Moreover, by intervening the lubricant 17 between the charge roll 16 and the cleaning roll 28, the charge roll 16 and the cleaning roll 28 do not contact each other, so that it is not necessary to dispose a mechanism to cause the cleaning roll 28 to separate from the charge roll 16. Consequently, the configuration of the entire image forming apparatus 10 does not become complicated. Further, because the toner 17A and the external additive 17C that are image forming material are used, there is no concern that this will cause secondary damage because the charge roll 16, the cleaning roll 28, the photoconductor drum 12, and the developing agent are not affected.

It will be noted that conductive materials are used for the toner 17A and the external additive 17C. Thus, frictional charge does not arise even when the lubricant 17 rubs between the charge roll 16 and the cleaning roll 28. Further, due to the lubricant 17, it becomes difficult for the charge roll 16 and the cleaning roll 28 to frictionally charge because the lubricant 17 is intervened between the charge roll 16 and the cleaning roll 28. Thus, a charge history resulting from frictional charge does not remain on the charge roll 16 and the cleaning roll 28.

It will be noted that the charge roll 16 and the cleaning roll 28 idle before the image forming apparatus 10 is operated (before image formation). Thus, the lubricant 17 intervened between the charge roll 16 and the cleaning roll 28 falls downward from the surface of the charge roll 16 or the cleaning roll 28. However, a receiver is disposed below the nip portion N to ensure that the falling lubricant 17 is caught by the receiver so that the inside of the image forming apparatus 10 is not contaminated by the lubricant 17.

In this exemplary embodiment, the surface of the charge roll 16 was charged to a predetermined potential by the power supply 14 to cause the lubricant 17 to be electrostatically attracted to the surface of the charge roll 16. However, a power supply may also be connected to the cleaning roll 28 to cause the lubricant 17 to be electrostatically attracted to the charged surface of the cleaning roll 28. Further, the lubricant 17 may include a binding resin to cause the lubricant 17 to bind to the surfaces of the charge roll 16 and the cleaning roll 28.

Further, in this exemplary embodiment, the lubricant 17 comprising the toner 17A and the external additive 17C was used as the intervening member intervened between the charge roll 16 and the cleaning roll 28, but it is not necessary for the intervening member to invariably be one comprising a mixture of the toner 17A and the external additive 17C. A lubricant comprising just toner or just an external additive may also be used.

Next, a second exemplary embodiment of the present invention will be described. It will be noted that description of portions that are the same as those in the first exemplary embodiment will be omitted.

Figure 4A:
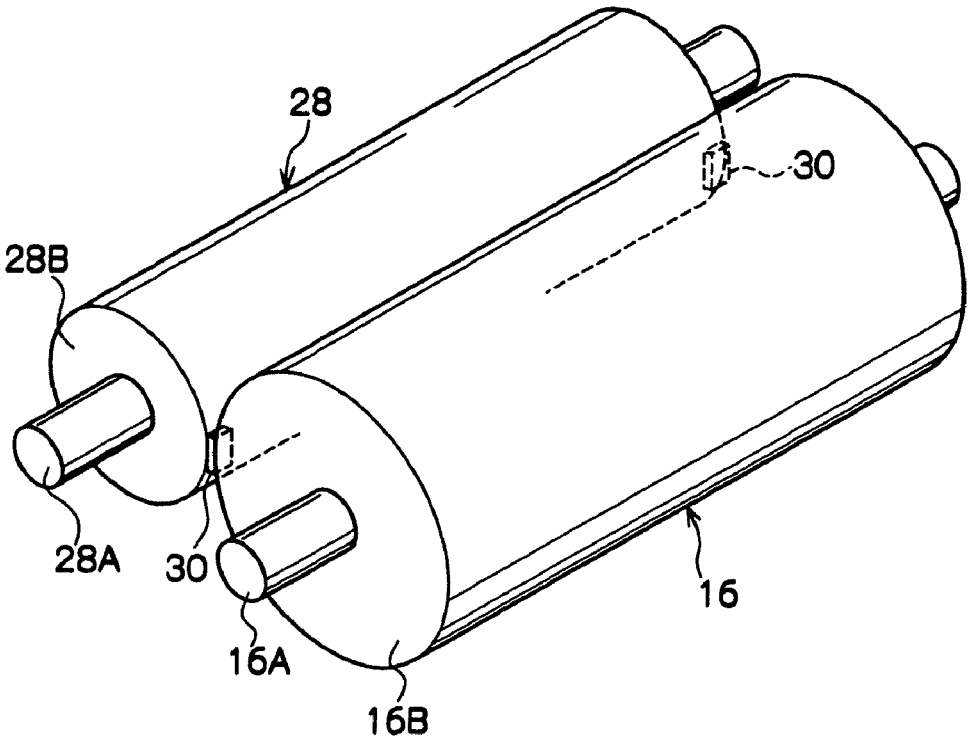
FIG. 4A is a perspective view showing a cleaning device pertaining to a second exemplary embodiment of the present invention.
Figure 4B:
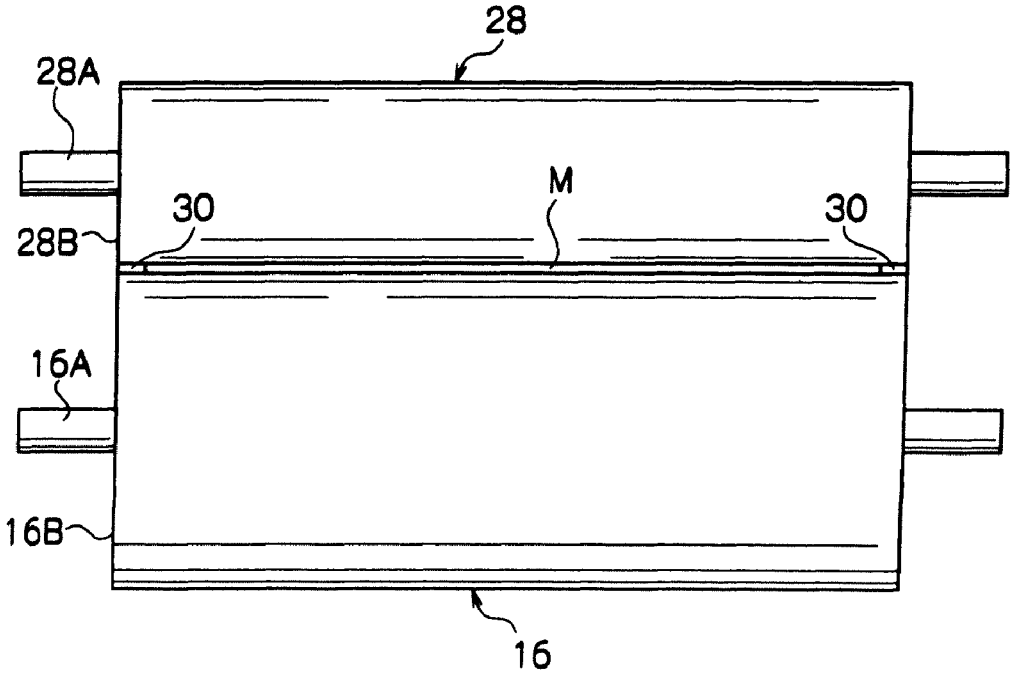
FIG. 4B is a side view showing the cleaning device pertaining to the second exemplary embodiment of the present invention.

As shown in FIG. 4A, prior to shipment or transport, spacers 30 are intervened at both longitudinal-direction ends between the charge roll 16 and the cleaning roll 28. Thus, as shown in FIG. 4B, when the nip portion N between the charge roll 16 and the cleaning roll 28 is seen from the direction orthogonal to the axial direction, a gap M is formed in the portion serving as the image forming region of the photoconductor drum 12.

Consequently, even when the image forming apparatus 10 is stored over a long period of time, the surface of the cleaning roll 28 (the sponge layer 28B) becomes deformed only at both end portions and does not become deformed in the central portion serving as the image forming region. Thus, images do not become distorted.

Next, a third exemplary embodiment of the present invention will be described. It will be noted that description of portions that are the same as those in the first exemplary embodiment will be omitted.

Figure 5A:
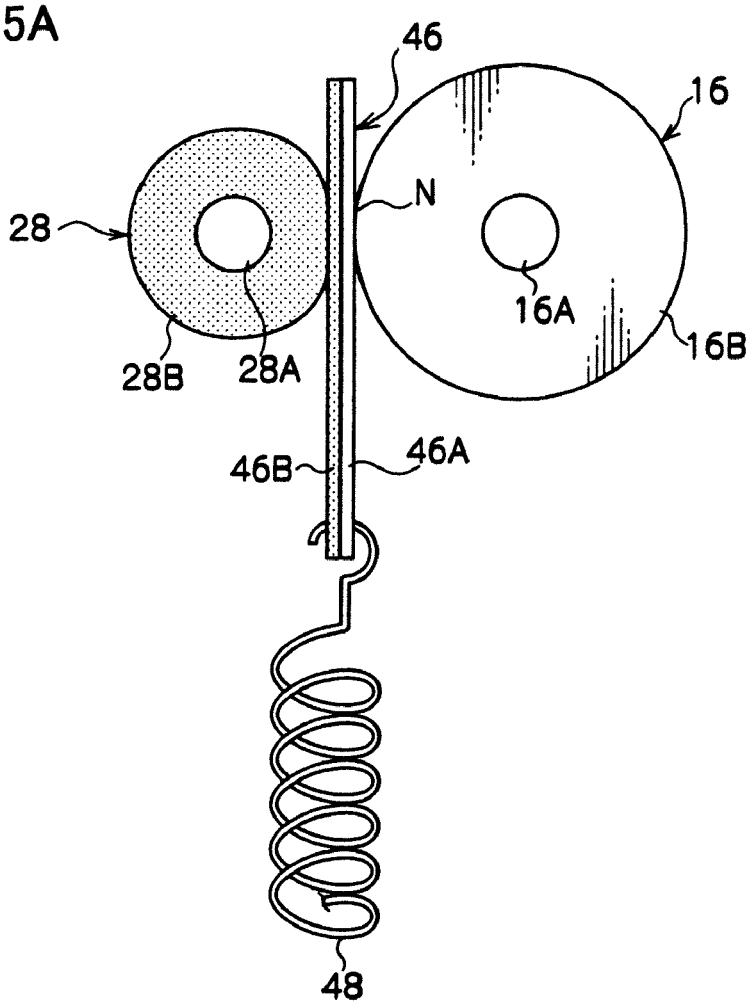
FIGS. 5A and 5B are side views where a cleaning device pertaining to a third exemplary embodiment of the present invention is seen from the axial direction.

As shown in FIG. 5A, a coil spring 48 is disposed below the nip portion N of the charge roll 16 and the cleaning roll 28. One end portion of the coil spring 48 is hooked to a convex portion 44 protrudingly disposed on the frame of the image forming apparatus 10, and one end of a conductive sheet 46 is retained on the other end of the coil spring 48.

The conductive sheet 46 is configured by sheet material 46A comprising carbon and sheet material 46B comprising a foaming agent, which are adhered together. In other words, the conductive sheet 46 has a two-layer structure, with one side being conductive and the other side being cushioning. It will be noted that a foaming agent whose hardness is lower than the hardness of the sponge layer 28B of the cleaning roll 28 is used for the foaming agent.

Prior to shipment or transport, the conductive sheet 46 is intervened between the charge roll 16 and the cleaning roll 28. Thus, shock between the charge roll 16 and the cleaning roll 28 is absorbed by the conductive sheet 46. By using the conductive sheet 46 as a cushion in this manner, it is not necessary to dispose a complicated mechanism in order to cause the charge roll 16 and the cleaning roll 28 to separate, and costs do not increase.

Figure 5B:
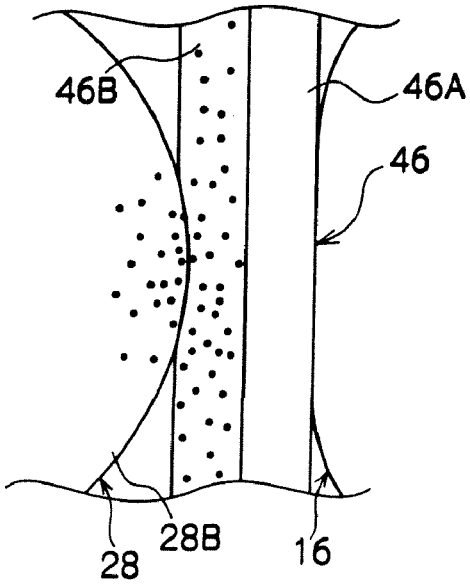

At this time, it is ensured that the sheet material 46A comprising carbon contacts the charge roll 16. Thus, as shown in FIG. 5B, deformation of the sponge layer 28B on the surface of the cleaning roll 28 is controlled as much as possible because the sheet material 46B comprising the foaming agent contacts the cleaning roll 28 and the hardness of the sheet material 46B comprising the foaming agent configuring the conductive sheet 46 is lower than the hardness of the sponge layer 28B.

Figure 6A:
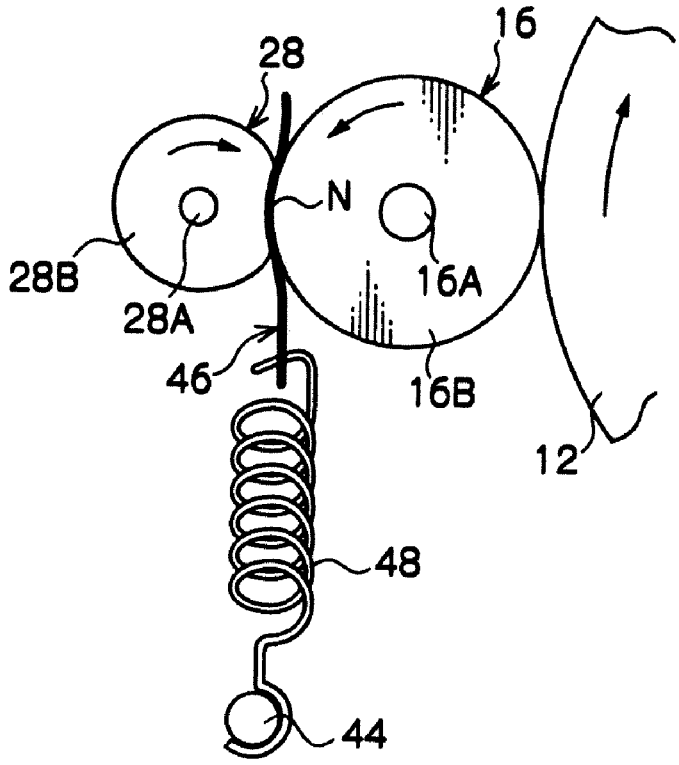
FIG. 6A is a diagram showing the state of the cleaning device prior to the shipment or transportation of an image forming apparatus.
Figure 6B:
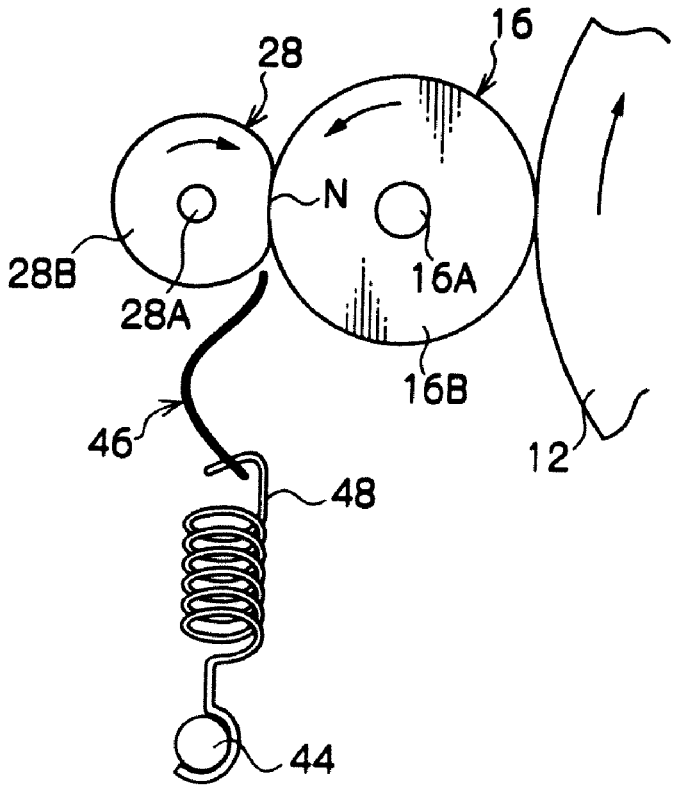
FIG. 6B is a diagram showing the state of the cleaning device when the image forming apparatus is operated.

As shown in FIG. 6A, when the conductive sheet 46 is intervened between the charge roll 16 and the cleaning roll 28, the conductive sheet 46 is biased downward. Then, when the image forming apparatus 10 is activated and the photoconductor drum 12 rotates, the charge roll 16 and the cleaning roll 28 rotate, and as shown in FIG. 6B, one end of the conductive sheet 46 is pulled by the coil spring 48 and the other end of the conductive sheet 46 is pushed out by the charge roll 16 and the cleaning roll 28, whereby the conductive sheet 46 comes out from between the charge roll 16 and the cleaning roll 28. By configuring the apparatus in this manner, it is not necessary to manually remove the conductive sheet 46 from between the charge roll 16 and the cleaning roll 28.

In this exemplary embodiment, the conductive sheet 46 was intervened between the charge roll 16 and the cleaning roll 28. Alternatively, at least one of the charge roll 16 and the cleaning roll 28 may be coated with toner and an external additive beforehand. Thus, the charge roll 16 and the cleaning roll 28 do not directly contact each other. Then, when the image forming apparatus 10 is activated, the toner and the external additive applied to the charge roll 16 or the cleaning roll 28 fall off when the charge roll 16 idles.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning roll that contacts a surface of a charge roll that charges a surface of an image carrier, the cleaning roll rotating and cleaning the surface of the charge roll; and an intervening member that is positioned between the contacting surfaces of the charge roll and the cleaning roll and causes the charge roll and the cleaning roll to separate from each other;

wherein the intervening member comprises a sheet material and the sheet material is biased downward in a rotating direction of the charge roll and the cleaning roll at a contact portion thereof.

2. A cleaning device comprising:

a cleaning roll that contacts a surface of a charge roll that charges a surface of an image carrier, the cleaning roll rotating and cleaning the surface of the charge roll; and an intervening member that is positioned between the contacting surfaces of the charge roll and the cleaning roll and causes the charge roll and the cleaning roll to separate from each other;

wherein the intervening member comprises a sheet material and the sheet material comprises two layers, one of which contacts the charge roll and is formed by a conductive member and the other of which contacts the cleaning roll and is formed by an elastic member.

* * * * *